United States Patent [19]

Nishida et al.

[11] 4,103,650

[45] Aug. 1, 1978

[54] HORIZONTAL TYPE DIESEL ENGINE

[75] Inventors: Tsuyoshi Nishida; Satoshi Tabushe; Kouichi Akeda, all of Sakai, Japan

[73] Assignee: Kubota, Ltd., Osaka, Japan

[21] Appl. No.: 724,864

[22] Filed: Sep. 20, 1976

[51] Int. Cl.[2] ..... F01M 13/00

[52] U.S. Cl. ..... 123/41.86; 123/196 R; 123/119 B

[58] Field of Search ..... 123/196 R, 41.86, 119 B, 123/195 C, 196 S

[56] References Cited

U.S. PATENT DOCUMENTS

| | | | |
|---|---|---|---|
| 2,056,762 | 10/1936 | Barr | 123/196 R |
| 2,907,309 | 10/1959 | Kolbe | 123/41.86 |

FOREIGN PATENT DOCUMENTS

| | | | |
|---|---|---|---|
| 1,164,158 | 2/1964 | Fed. Rep. of Germany | 123/41.86 |
| 11,690 of | 1900 | United Kingdom | 123/41.86 |

*Primary Examiner*—Ronald H. Lazarus
*Attorney, Agent, or Firm*—Armstrong, Nikaido, Marmelstein & Kubovcik

[57] ABSTRACT

A horizontal type Diesel engine wherein a gear case is juxtaposed to a crankcase axially of a crank shaft, said crankcase horizontally receiving a cylinder therein and a radiator and a fuel tank are juxtaposed on top of the crankcase. The Diesel engine is characterized by a breather disposed on the upper wall of the gear case substantially at the middle between the front and rear ends thereof and an oil partition wall opposed to the breather, the arrangement being such that even if the vehicle on which this engine is mounted is tilted, the lubricating oil contained in the crankcase and gear case will not leak. Further, a governor shaft vertically pivotally supported by the gear case has its one end projecting into the breather so as to prevent the oil from leaking into the outside along the end of the governor shaft.

10 Claims, 7 Drawing Figures

Fig. 7 (II)

Fig. 7 (III)

HORIZONTAL TYPE DIESEL ENGINE

BACKGROUND OF THE INVENTION

The present invention relates to a horizontal type Diesel engine to be mounted on a small farm tractor, small construction equipment or other vehicles which do work frequently on slopes or uneven ground.

As is known in the art, in a horizontal type engine having a gear case juxtaposed to a crankcase axially of a crank shaft, said crankcase horizontally receiving a cylinder therein, it is usual with the breather mounted on said gear case to be disposed at an upper position on the rear wall of the gear case. If such engine is mounted on a vehicle, such as a farm tractor and construction equipment, which does work on slopes, the rearward tilting of the vehicle results in the oil in the gear case being tilted concomitantly with the tilting of the engine and often entering said breather from which it then leaks into the outside. In an effort to preclude such leaks, conventional measures include the provision of a partition wall inside the breather opposed to the gear case, but such measures have produced no satisfactory results. Further, in said horizontal type engine, especially Diesel engine, the governor shaft is vertically pivotally supported by the gear case, and in order to meet the needs including the adjustment of a governor lever fixedly set on said shaft, one end of said shaft is projected into the outside through the upper wall of the gear case and the projecting portion is covered with a plug to prevent the oil from leaking into the outside of the engine. The plug is provided with sealing means, but incorrect fitting of such seal or machining errors thereof inevitably produce leakage of oil.

SUMMARY OF THE INVENTION

A first object of the present invention is to provide a horizontal type Diesel engine designed so that even if the engine is tilted along with a vehicle on which it is mounted, the lubricating oil in the crankcase and gear case is prevented from leaking into the outside through the breather and contaminating the engine and the vehicle.

A second object of the invention is to provide a horizontal type Diesel engine designed so that the lubricating oil in the crankcase and gear case is prevented from leaking into the outside along one pivoted end of the governor shaft vertically pivotally supported by the gear case, and contaminating the engine and vehicle.

A third object of the invention is to provide a horizontal type Diesel engine equipped with a breather which is superior in performance.

A fourth object of the invention is to provide a horizontal type Diesel engine in which the seal at one pivoted end of the governor shaft is dispensed with to simplify the construction and the breather is located at a particular position, thereby enabling the longitudinal dimension of the engine to be reduced.

These and further objects and novel features of the invention will more fully appear from the following detailed description when the same is read in connection with the accompanying drawings. It is to be expressly understood, however, that the drawings are for purpose of illustration only and are not intended as a definition of the limits of the invention.

DETAILED DESCRIPTION OF THE INVENTION

Figure 1:
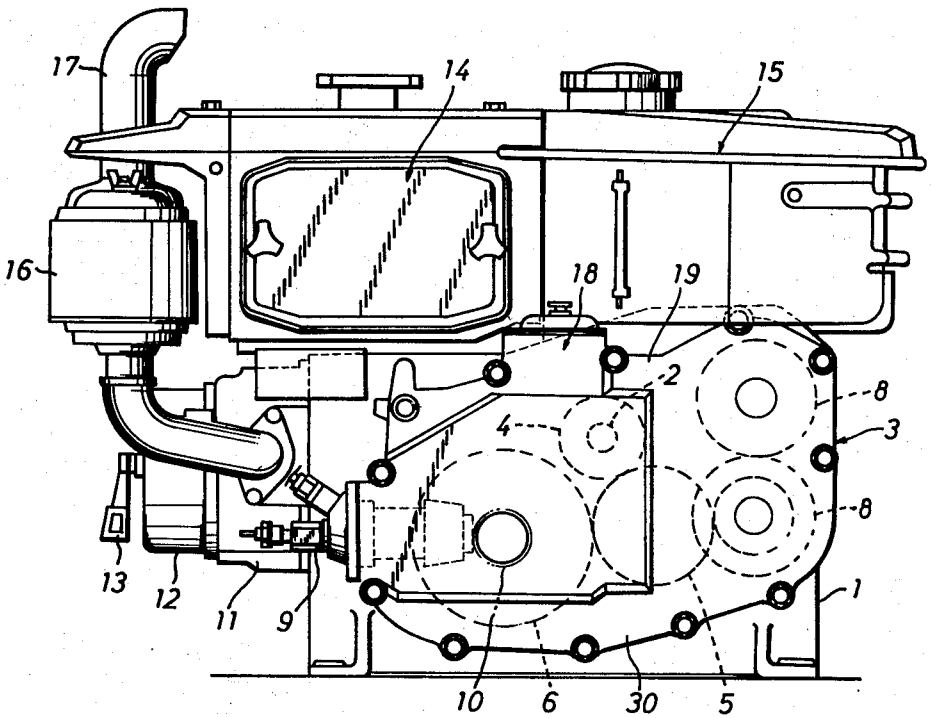
FIG. 1 is a front view of a horizontal type Diesel engine according to the present invention.

Preferred embodiments of the invention will now be described with reference to the drawings. FIG. 1 is a front view of a horizontal type Diesel engine according to the invention, wherein 1 designates a crankcase in which a horizontally disposed cylinder (not shown) is received; 2, a crank shaft supported by the crankcase; and 3 designates a gear case juxtaposed on one side of the crank shaft 2 and communicating with the latter, inside which gear case there are installed in a predetermined gear train a crank gear 4, an idle gear 5, a cam gear 6, a starting gear 7 and a pair of balancing gears 8. Lubricating oil is contained in said crankcase 1 and gear case 3 to a predetermined level.

Designated at 9 is an injection pump disposed in the front of said gear case 3 and adapted to be driven by a cam 10 on the cam gear 6. A cylinder head 11 is fixed on the front of said crankcase 1 so as to project from the latter. The numeral 12 designates a head cover provided with a decompression mechanism 13. Mounted on said crankcase are a radiator 14 and a fuel tank 15, while a suction member 16 and an exhaust member 17 extend upwardly from opposite sides of said cylinder head 11.

Figure 2:
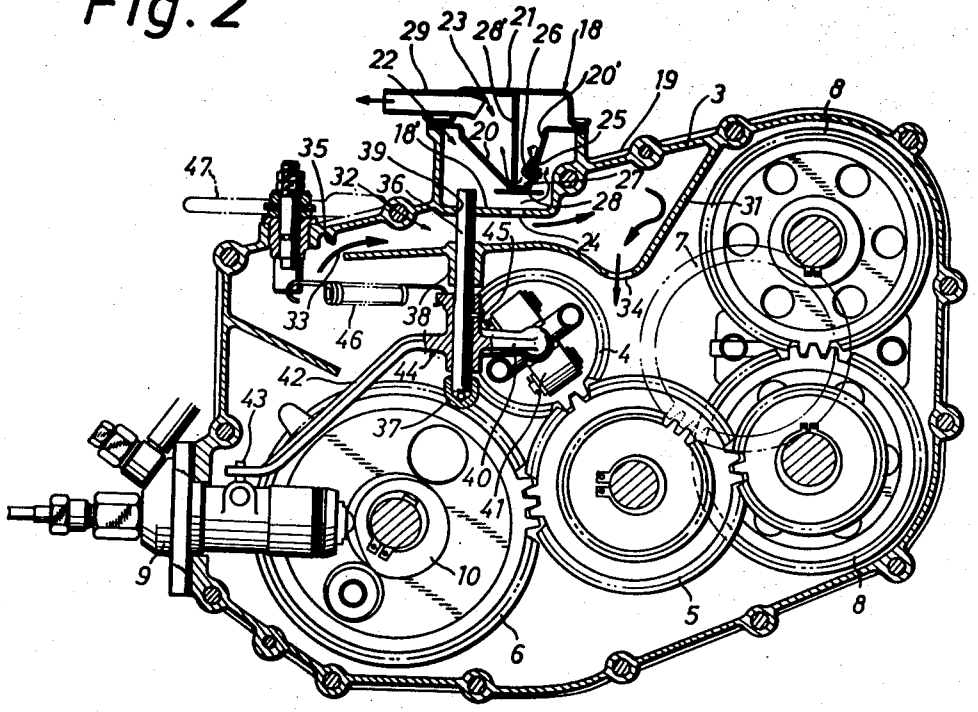
FIG. 2 is a front view, in longitudinal section, of a gear case and related parts.

In such engine, a breather 18, which is one of the features of the invention and which is in the form of a small container as shown in FIG. 2, is integrally provided on an upper wall 19 constituting said gear case 3, substantially at the middle between the front and rear ends of said upper wall. The breather 18 is internally divided into two sections, upper and lower, by a partition wall 20 which is V-shaped in cross-section. Thus, the partition wall 20 and the upper wall 19 of the gear case cooperate with each other to define a first breather chamber 22 while the partition wall 20 and a cap 21 cooperate with each other to define a second breather chamber 23. The upper wall 19 of the gear case is provided with a first breather hole 24 while the partition wall 20 is provided with a second breather hole 25 in one inclined wall 20' and a valve 26 is installed thereon so that it can be opened and closed. The lowermost portion of the partition wall 20 is provided with an oil return hole 27 and a first oil barrier plate 28 horizontally extending and opposed to said first breather hole 24. Further, the cap 21 is provided with a second oil barrier plate 28' dividing the second breather chamber 23 into two parts, front and rear, and it is also provided with an air discharge port 29 in the front thereof.

On the other hand, a partition wall 31 extends from the inner surface of the front wall 31 of the gear case 3 at right angles therewith toward the side wall (not shown) of the crankcase 1, said partition wall 31 covering the breather 18 between the group of gears and the upper wall 19 of the gear case and being relatively long in length. Therefore, the partition wall 31 defines a pre-breather chamber 32 in the form of a narrow passage between it and the upper wall 19 of the gear case, and front chamber communication ports 33 and 34 which communicate with each other are provided on the front and rear sides of the partition wall 31. In addition, the portion of the upper wall 19 of the gear case constituting the front chamber communication port 33 on the front side is provided with a downwardly extending oil barrier projection 35, and the front chamber communication port 34 on the rear side is formed in the bottom of a recess.

Next, a construction for pivotally supporting one end of a governor shaft 36, which is another feature of the invention, will now be described.

The governor shaft 36 is disposed laterally of the crank shaft 2 at right angles therewith, i.e. it is vertically disposed, the lower end of said governor shaft being pivotally supported in a bearing portion 38 which projects from the inner surface of the front wall 30 of the gear case 3 as in the case of the partition wall 31 constituting said pre-breather chamber 32, the intermediate portion of said shaft being pivotally supported in a bearing portion 38 provided on said partition wall 31, the upper end of said shaft being pivotally supported in a shaft-receiving hole 39 provided in the bottom plate 18' of the breather 18 which is the upper wall 19 of the gear case, it being noted that the upper end portion of said governor shaft projects into the breather 18, or the first breather chamber 22 in the illustration. As is known, the governor shaft 36 has a governor lever 44 secured thereto by a screw 45, said governor lever having one arm 40 thereof engaged with a centrifugal governor 41 provided on the crank shaft 2 and the other arm 42 thereof engaged with a rack pin 43 in a rack mechanism for the injection pump 9. Therefore, the governor shaft 36 and the governor lever 46 can be moved as a unit. The governor lever 44 is also provided with a governor spring 46 connected to a portion of an engine speed control lever 47.

Figure 3:
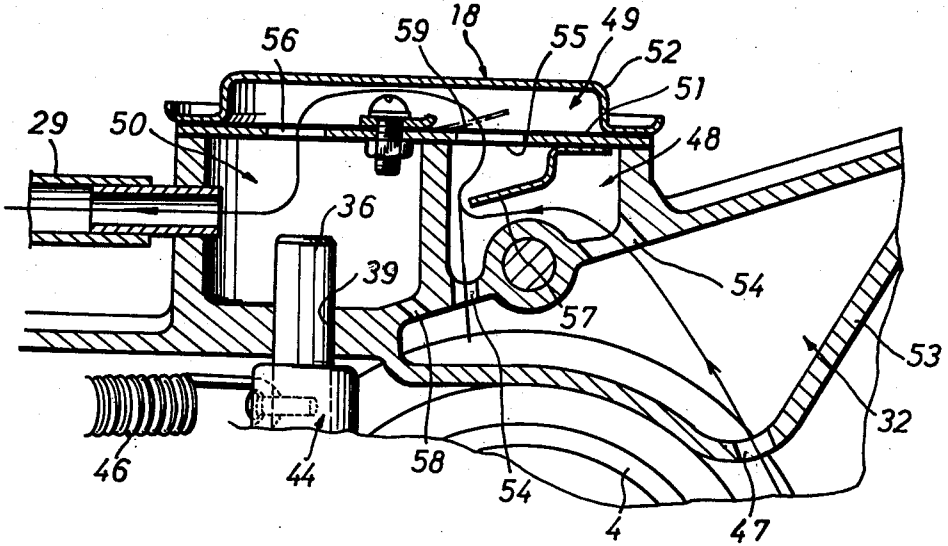
FIG. 3 shows a modification of the principal portions of FIG. 2 according to another embodiment of the invention.

FIG. 3 shows the principal portions of another embodiment of the invention, which differs from the embodiment shown in FIG. 2 in that the interior of the breather consists of three chambers, the front breather chamber 32 has only one front chamber communication port 47 and the governor shaft is pivotally supported at two places, the lower end and the upper portion thereof. Further explaining, this embodiment is the same as in FIG. 2 in that the breather 18 is integrally provided on the upper wall 19 of the gear case 3 substantially at the middle between the front and rear ends thereof, but in this embodiment the breather 18 consists of a first, second and third breather chambers 48, 49 and 50, and the first and third chambers 48 and 50 are disposed in front and in rear while the second chamber 49 is defined between a cap 52 and a partition wall 51 which covers the chambers 48 and 50. A pre-breather chamber 32 which is V-shaped in cross-section is defined by a partition wall 53 opposed to the inner side of the first chamber 48 facing the gear case 3, and a front chamber communication port 47 is provided in the lowermost portion of the partition wall 53, as in the case of FIG. 2. Further, communication is established between the first chamber 48 and the front chamber 32, between the second chamber 49 and the first chamber 48, and between the second chamber 49 and the third chamber 50, through a first, second and third breather holes 54, 55 and 56, respectively. The second breather hole 55 is provided with a valve 59 so that it can be opened and closed. The first chamber 48 has a barrier plate 57 disposed in the upper region thereof while the third chamber 50 is provided with a forwardly directed air discharge port 29 disposed in the upper region thereof and an oil return hole 58 in the bottom thereof leading to the pre-breather chamber 32. In addition, there are two said first breather holes 54 disposed in front and in rear, one of which serves as an oil return hole. Further, said third breather hole 56 also may, of course, be provided with a valve. On the other hand, the lower end of the governor shaft 36 is pivotally supported in a bearing (not shown) similar to the bearing 37 shown in FIG. 2 while the upper portion of said shaft is pivotally supported in a shaft-receiving hole 39 formed in the third breather chamber 50, with the upper end of the shaft projecting into the chamber 50.

Figure 4:
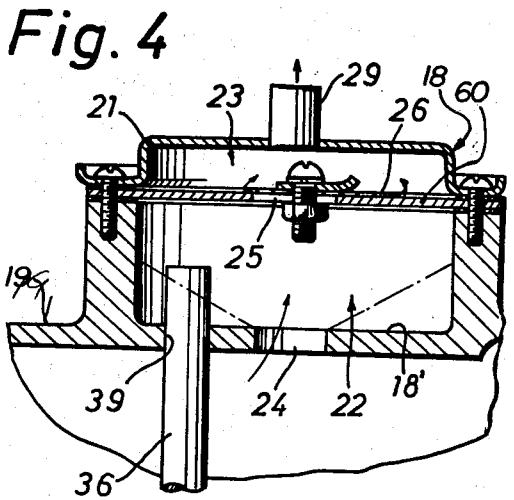
FIGS. 4, 5 and 6 are front views, in longitudinal section, of breathers according to other embodiments of the invention.
Figure 6:
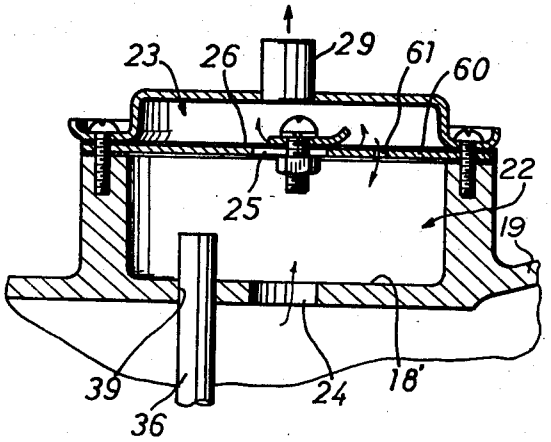
Figure 5:
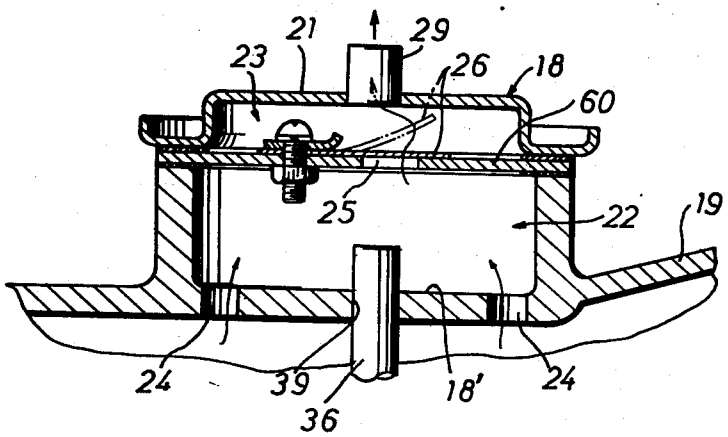

FIGS. 4, 5 and 6 are sectional views of breathers according to other embodiments of the invention, wherein the same reference characters as those used in FIG. 2 designate the same parts. These will now be outlined.

In FIG. 4, the breather 18 comprises a first breather chamber 22 and a second breather chamber 23 which are separated by a partition wall 60 in the form of a horizontal plate, said first breather chamber 22 communicating with the pre-breather chamber 32 through a first breather hole 24, said second breather chamber 23 communicating with said first breather chamber 22 through a second breather hole 25 and with the outside through an air discharge port 29. In this case, there is a single said first breather hole 24 disposed at the middle of the bottom 18' of the chamber 22, while the second breather hole 25 is provided with a valve 26 so that it can be opened and closed.

The embodiment shown in FIG. 5 is the same as that shown in FIG. 4 except that a pair of first breather holes 24, 24 disposed in front and in rear are provided in the bottom wall 18' of the first breather chamber 22. The embodiment shown in FIG. 6 is the same as that shown in FIG. 4 except that an oil return hole 61 is provided in a partition wall 60. In this connection, said oil return hole 61 may be provided in the partition wall 60 in FIG. 5.

The operation of the engine will now be described chiefly with reference to FIG. 2.

In a certain length of time after the engine is started, the temperature in the crankcase 1 and in the gear case 3 is elevated and hence the air therein is expanded and the pressure is increased. Besides this, upon retraction of the piston, the pressure in the two cases 1 and 3 is further increased, so that the air current pushes the valve 26 in the breather 18 open and flows out into the atmosphere through the air discharge port 29. More particularly, the air current containing oil in a mist form inside the gear case 3 first strikes the outer peripheral surface of the partition wall 31 and while allowing a portion of the oil to adhere to the wall 31 it moves around the periphery of the wall 31 and then into the front chamber communication port 33 in the direction of arrow. In this connection, it is to be noted that the presence of the oil barrier plate 35 at the front chamber communication port 33 removes a portion of mist-like oil as the latter strikes it. The air current which has thus entered the front breather chamber 32 passes rapidly through the narrow passage in the chamber 32, as indicated by an arrow, and returns to the gear case through the front chamber communication port 34 on the rear side, with a portion of the air current flowing into the first breather chamber 22 through the first breather hole 24 and then flowing through a by-pass defined by the first oil barrier plate 28 into the second breather hole 25 provided in the partition wall 20, where it pushes the valve 26 open and enters the second breather chamber 23, from which it is then discharged into the atmosphere through the air discharge port 29 via a by-pass defined by the second oil barrier plate 28'. The oil portion separated in the second breather chamber 23 flows down into the first breather chamber 22 through the oil return hole 27 and then returns to the gear case 3 through the first breather hole 24.

The description given above refers to a case where the engine is not tilted. When the engine is tilted, the oil level angularly rises to the front or rear of the crankcase 1 and gear case 3. In the present invention, however, since the breather 18 is positioned on the upper wall 19 of the gear case 3, which is located at a higher level, substantially at the middle between the front and rear ends of said upper wall 19, there is no possibility of the oil flowing thereinto along with the air current.

In addition, in the embodiment shown in FIG. 3, since the breather 18 is composed of the first to third chambers 48, 49 and 50, the effect of separating oil from the air current entering said chambers is greater than that of the breather of FIG. 2.

In the embodiment shown in FIG. 4, the breather 18 has a relatively simple construction, and its function is similar to that of the FIG. 2 breather and can be fully developed. In the FIG. 5 embodiment, the presence of a pair of first breather holes 24, 24 disposed in front and in rear allows the air current containing mist-like oil to flow from the pre-breather chamber 32 to the first breather chamber in differnt paths. On the other hand, one of said holes 24 serves as an oil return hole while the other hole 24 provides for the entry of air current. Particularly, in contrast to the FIG. 4 embodiment wherein upon tilting of the engine the return oil tends to stay at corners of the first breather chamber 22, as shown in phantom lines, the FIG. 5 embodiment is capable of satisfactorily returning the return oil to the gear case 3, thus preventing it from being discharged into the atmosphere along with the air current. The FIG. 6 embodiment is arranged so that the return oil collected in the second breather chamber can be satisfactorily returned to the gear case 3 via the first breather chamber 22.

Figure 7:
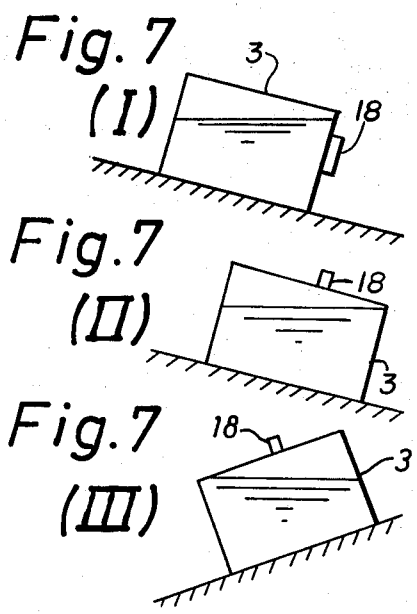
FIG. 7 is an explanatory view showing the relationship between the oil level in the gear case when tilted and the breather position, making a comparison between the prior art and the present invention.

It will now be understood from the above that according to the present invention there is provided a horizontal type Diesel engine wherein a gear case is juxtaposed to a crankcase axially of a crank shaft, said crankcase horizontally receiving a cylinder, said engine comprising a breather which establishes communication between the interior of said gear case and the atmosphere and which is disposed on the upper wall of said gear case subtantially at the middle between the front and rear ends of said upper wall, an oil partition wall opposed to said breather and disposed in the gear case, and a pre-breather chamber communicating with the gear case and disposed between said oil partition wall and said upper wall mounting said breather thereon. This arrangement prevents the oil in the crankcase and gear case from entering the breather and leaking into the atmosphere through the air discarge port even if the engine is tilted upon tilting of a vehicle on which it is mounted. Therefore, there is no possibility of the oil contaminating the vehicle, not to speak of the engine. There is no oil loss, either. This can be clearly understood from FIG. 7, in which I indicates a conventional system and II and III indicate the present invention. Further, in the present invention, since the breather is of the horizontal type as illustrated in the embodiments, it is easy to disassemble and re-reassemble as compared with a conventional breather of the vertical type. Moreover, the gear case is juxtaposed to the crankcase so as to project axially of the crank shaft, and since the breather is installed on the upper wall of said gear case, operations including maintenance and inspection thereof can be easily carried out from a lateral side of the vehicle, i.e. from the front of the engine. Further, according to the invention, since the breather is positioned on the upper wall of the gear case substantially at the middle between the front and rear ends of said upper wall, the disadvantage of a conventional breather disposed on the rear wall of the gear case making it compulsory to separate the set of gears in the interior from the breather is eliminated, enabling a pair of balancing gears to be disposed close to the rear wall of the gear case, as shown in FIGS. 1 and 2. Coupled with this, the fact that the breather is not projected from the rear wall reduces the longitudinal dimension of the gear case so much, so that the invention contributes to making the engine compact.

Further, in the invention, since one end of the governor shaft vertically pivotally supported by the gear case projects into said breather, even if the oil leaks through a clearance between the governor shaft and the shaft receiving hole in the upper wall, such leakage oil is secondarily received by the breather and allowed to return to the gear case, so that there is no oil leaking directly into the outside of the engine. Also, this arrangement of placing one end of the governor shaft inside the breather enables the operator to easily grip said projecting end of said shaft without the need to use any special tool once the upper cap of the breather is removed when it is desired to fix the governor lever to the governor shaft by a screw. Thus, positioning of the governor shaft can be quickly effected. There is no need to positively prevent leakage of oil at the upper wall of the gear case where the upper end of the governor shaft is pivotally supported, and hence there is no need to provide any seal member for such pivotal support portion, thus greatly economizing the components and the steps of working.

We claim:

1. A horizontal type Diesel engine wherein a gear case is juxtaposed to a crankcase axially of a crank shaft, said crankcase horizontally receiving a cylinder therein, and a radiator and a fuel tank are juxtaposed on top of said crankcase, said engine being characterized by comprising a breather which establishes communication between the interior of said gear case and the atmosphere and which is disposed on the upper wall of said gear case substantially at the middle between the front and rear ends of said upper wall, an oil partition wall opposed to said breather and disposed in said gear case, a pre-breather chamber defined between said oil partition wall and said upper wall mounting said breather thereon, and a governor shaft pivotally vertically supported by said gear case and having one end thereof projecting into said breather.

2. A horizontal type Diesel engine as set forth in claim 1, wherein the breather is of the horizontal type and the interior thereof is divided into at least two breather chambers by a partition wall or walls.

3. A horizontal type Diesel engine as set forth in claim 1, including a partition wall which divides the interior of the breather into two breather chambers, upper and lower, and which is V-shaped in cross-section, said partition wall having a breather hole adapted to be opened and closed by a valve and also having an oil return hole formed in the bottom thereof.

4. A horizontal type Diesel engine as set forth in claim 1, including partition walls dividing the interior of the breather into three breather chambers, a first one in front, a second one at top and a third one in rear, said breather chambers communicating with each other, the partition wall common to said three chambers being provided with a breather hole establishing communication between said first and second chambers and/or a breather hole establishing communication between said second and third chambers, such breather hole being provided with a valve which can be opened and closed, said first and/or third chamber being provided with an oil return hole communicating with the gear case.

5. A horizontal type Diesel engine as set forth in claim 1, including a partition wall in the form of a plate dividing the interior of the breather into two breather chambers, upper and lower, said partition wall being provided with a breather hole adapted to be opened and closed by a valve.

6. A horizontal type Diesel engine as set forth in claim 5, wherein the partition wall is provided with an oil return hole.

7. A horizontal type Diesel engine as set forth in claim 5, wherein the bottom of the breather is formed with two breather holes, front and rear, one of which functions as an oil return hole.

8. A horizontal type Diesel engine as set forth in claim 6, wherein the bottom of the breather is formed with two breather holes, front and rear, one of which functions as an oil return hole.

9. A horizontal type Diesel engine as set forth in claim 1, wherein the governor shaft is pivotally supported at its lower end in a bearing projecting from the inner surface of the front wall of the gear case, at its intermediate portion in the partition wall projecting from the inner surface of the front wall of the gear case and constituting the pre-breather chamber, and at its upper portion in a shaft receiving hole formed in the bottom of the breather.

10. A horizontal type Diesel engine as set forth in claim 1, wherein the governor shaft is pivotally supported at its lower end in a bearing projecting from the inner surface of the front wall of the gear case and at its upper portion in a shaft receiving hole formed in the bottom of the breather.

* * * * *